United States Patent [19]

Renton

[11] 4,383,898

[45] May 17, 1983

[54] DE-WATERING OF METAL SURFACES

[75] Inventor: Stanley Renton, Penkridge, England

[73] Assignee: Albright & Wilson Limited, Warley, England

[21] Appl. No.: 247,809

[22] Filed: Mar. 26, 1981

Related U.S. Application Data

[63] Continuation of Ser. No. 45,754, Jun. 5, 1979, abandoned.

[30] Foreign Application Priority Data

Jun. 7, 1978 [GB] United Kingdom ..... 26440/78
Aug. 18, 1978 [GB] United Kingdom ..... 33917/78

[51] Int. Cl.[3] ..... C25D 5/48; B05D 3/10; C23F 1/00

[52] U.S. Cl. ..... 204/35 R; 134/29; 148/6.2; 156/664; 204/51; 204/129.1; 427/331; 427/354

[58] Field of Search ..... 204/35 N, 35 R, 129.1, 204/51; 427/331, 354, 444; 252/194; 34/9; 134/29; 156/625, 664, 667; 148/6.2

[56] References Cited

U.S. PATENT DOCUMENTS 3,012,917 12/1961 Riou ..... 148/6.14
3,647,650 3/1972 Yamagishi ..... 204/35 R
3,653,983 4/1972 Ziehr et al. ..... 148/6.14 R
3,966,570 6/1976 Yamagishi ..... 204/140

OTHER PUBLICATIONS

A. Kenneth Graham, Electroplating Engineering Handbook, Reinhold Publishing Corp., New York, 1962, pp. 207, 208.

Kirk-Othmer Encyclopedia of Chemical Technology, Interscience Publishers, vol. 12 (1st Ed.), pp. 573-575; vol. 6 (2nd Ed.), pp. 853-856, 869-870; vol. 19 (2nd Ed.), pp. 507-514, 566-580.

Frederick Lowenheim, Electroplating, McGraw-Hill, New York, 1978, p. 80.

Metal Finishing Guidebook and Directory, 1978; Metals and Plastics Publications, Hackensack, N.J., p. 126.

*Primary Examiner*—G. L. Kaplan
*Assistant Examiner*—William Leader
*Attorney, Agent, or Firm*—Frishauf, Holtz, Goodman & Woodward

[57] ABSTRACT

After a metal finishing treatment by means of an aqueous solution that forms a surface of free metal, or comprising metal ions, exposed to the environment, the surface is rinsed, contacted with a soap solution and subjected to a final rinse. The treatment provides enhanced corrosion resistance and rapid spontaneous dewatering after the final rinse.

14 Claims, No Drawings

DE-WATERING OF METAL SURFACES

This is a continuation, of application Ser. No. 45,754 filed June 5, 1979, now abandoned.

The present invention relates to the dewatering of metal surfaces after metal finishing treatments.

It is important to dry metal surfaces quickly after aqueous metal finishing treatments, including, for example, electroplating, anodising, chemical polishing, alkaline degreasing and acid pickling, in order to avoid problems of corrosion or staining. Most metal finishing sequences conclude with a water rinse and a drying stage.

The principal methods of drying, hitherto, have been atmospheric drying, external heating, forced air drying, absorption and chemical dewatering. Atmospheric drying requires that the final rinse be effected at high temperature and that the work has a sufficient heat capacity in relation to its surface area to evaporate the residual water rapidly. It is thus restricted in application, generally undesirably slow, and expensive in energy consumption. It is also liable to leave water marks or stains. Drying by air jet requires capital investment in special equipment, is relatively slow compared with some alternatives and is limited to work where the surfaces to be dried are accessible to external air jets.

Heating in ovens or by infra red heat requires expensive equipment, may leave stains or water marks and is costly in energy, while physical absorption, e.g. by rubbing with hot sawdust, involves high labour costs and nuisance from airborn dust as well as problems of removing the dust from the surface.

Because of the foregoing disadvantages, there is a growing trend towards the use of the chemical dewatering agents. These have hitherto been based on organic solvents which displace water from the metal surface, sometimes in conjunction with a dissolved film forming agent such as a cationic surfactant which adheres to the metal surface to provide a water repellant film, and which may help to improve corrosion resistance after drying. The main disadvantages of these dewatering systems are their high cost and the nuisance of the organic solvents which often cause hazards due to flammability or toxic vapour, and which have to be contained in special covered tanks.

We have now discovered a completely novel dewatering system which has substantial advantages over the known system. In particular, it is an aqueous system and so avoids the major problems posed by use of organic solvents. It is surprisingly cheap and effective and also provides enhanced corrosion resistance to certain surfaces and may also remove or neutralise any toxic, soluble metal ions remaining on the work.

A particularly surprising feature of our invention in view of the long standing nature of the problem, is its simplicity, although we have not found it easy to explain how and why it works. Briefly summarised, our invention lies in the discovery that when articles, which have been subjected to metal finishing treatments with aqueous solutions that form an exposed free metal or metal ion containing surface, are dipped into a dilute soap solution immediately prior to the final rinse, the surface dewaters, after the final rinse, with exceptional rapidity, and thereafter often exhibits enhanced resistance to corrosion.

It has been suggested in the past to try to improve the rate of drainage after the final rinse by reducing the surface tension of the rinse water with surfactants. In particular, it has been proposed to add soap to the final rinse water for this purpose. The method has not been widely used because it is not very effective. Our invention uses soap to provide an opposite effect. When applied prior to the final rinse, soap solution is apparently capable of providing a water repellent film, which does not noticeably repel the soap solution itself, but gives extremely rapid spontaneous dewatering when the work is removed from a final rinse in clean water.

The foregoing effect is highly surprising, since soluble soaps normally function as wetting agents, rather than water repellents, and is difficult to explain in terms of a credible mechanism. It is known that soaps react with polyvalent metal cations such as those introduced onto surfaces which have been treated by some metal finishing treatments which are effective preliminaries to the dewatering operation of this invention. However, any explanation in terms of reaction between the soap and the metal cations is difficult to sustain in the face of our observation that best results from the soap treatment of the present invention are obtained by applying the soap solution after the surface has been thoroughly rinsed in clean water.

Our invention provides a method of dewatering a metal surface, after a metal finishing treatment with an aqueous solution that forms an exposed, free metal or metallic ion-containing surface, which method comprises subjecting the surface after the treatment to a first aqueous rinse, to the extent necessary substantially to remove any treatment solution from the surface, contacting the rinsed surface with aqueous soap solution as herein defined, subjecting the surface, after removal from the soap solution, to a final rinse with water, and allowing the surface to drain. In the first rinse, treatment solution, e.g. ones containing metallic ions and or acid is substantially removed.

The metal finishing treatments which are generally applicable to our invention are those in which (i) metal is deposited, chemically or electrochemically, to form an exposed surface as in electroplating, (ii) metal is removed from a metal surface, chemically or electrochemically, as in etching, chemical polishing or electropolishing, or (iii) an inert film or coating is removed from a metal surface as in acid pickling, or alkaline degreasing. The method of this invention is not normally operative in those cases where the effect of the treatment is to form an inert, non-metallic film or coating on the metal surface of sufficient thickness to isolate the metal, or any metal ions, from contact with the soap solution.

Typical examples of metal finishing treatments which may constitute or be comprised in the metal finishing treatment stage of our invention, include electroplating with copper (e.g. from acid copper solutions, or from copper cyanide or copper pyrophosphate), zinc, (e.g. from acid or cyanide baths), cadmium, cobalt, nickel, iron, chromium (either from trivalent chromium electrolytes, or from hexavalent chromium), silver, gold, platinum, lead and tin and with alloys of the foregoing metals. The method is also operative after acid pickling, chemical polishing, electropolishing, degreasing or etching metal surfaces.

Examples of processes which provide passive coatings which are not suitable for dewatering according to our invention, at least without special treatments to remove non-metallic layers, include phosphating of mild steel with or without chromic acid seal, black oxide treatment of mild steel with caustic soda/sodium/nitrate/sodium chromate, electropolishing of stainless steel, chemical oxidation of aluminum with, for example, an alkaline potassium ferricyanide solution, treatment of metals with film forming cleaners such as silicate inhibited alkaline cleaners, and anodising of aluminum followed by sealing with demineralized water, to block the pores of the anodic film.

Electropolished stainless steel can be dewatered according to our invention if it is immersed in hydrochloric acid solution and rinsed, before contacting with the soap solution. Presumably the acid removes the oxide film formed by electropolishing. Anodised aluminum can be dewatered, provided the water sealing stage is omitted. The mechanism may possibly involve absorption of the soap through pores in the unsealed film or interaction of the soap with aluminum ions and/or anodising acid entrapped in the film.

The negative effect of silicate inhibited cleaners may be avoided by removing the resulting silicate film, e.g. with a solution of sulphuric acid and hydrofluoric acid.

Surprisingly, chromate passivation of zinc does not prevent dewatering according to our invention, possibly because of the formation of $Cr^{III}$ions in the chromate film, due to reduction of the chromate by zinc.

The first rinse is necessary, except after alkaline cleaning, to prevent excessive drag-in of plating solution or acids into the soap solution which tends to precipitate the soap. We have found that the more thorough the rinising, the more satisfactory the process.

"Soap" as used herein means any water soluble salt of an aliphatic, saturated or unsaturated carboxylic acid having from 10 to 24 carbon atoms, preferably an aliphatic acid having 12 to 18 carbon atoms. Usually potassium or, preferably sodium salts of fatty carboxylic acids such as stearic, palmitic, dodecanoic, myristic, oleic, linoleic, linolenic acids and mixtures thereof are employed. Lithium, ammonium and water soluble amine salts are also operative, e.g. ethanolamine salts. Other suitable soaps include sodium resinates.

The effective concentration of the soap depends on the number of carbon atoms. $C_8$ salts are ineffective, $C_{10}$ soaps are marginally useful at concentrations of e.g. 10 g/l, $C_{12}$ soaps are effective at concentrations down to 2 g/l, while $C_{14-18}$ soaps are effective at concentrations as low as 0.05 g/l. Generally, however, it is impractical to use even the preferred soaps at concentrations below about 0.1 g/l because the solution becomes exhausted too rapidly. We prefer to use solutions of from 0.5 to 5 gm/l e.g. 1 to 3 g/l soap, although higher concentrations, up to the maximum fluid concentration attainable are operative.

Soaps above $C_{20}$ give rise to problems of solubility, as well as commercial availability. Potassium soaps of $C_{22}$ (Behenic acid) are marginally useful, but the corresponding sodium salt is too insoluble.

Preferably, the solution also contains a dispersant, such as anionic detergent to disperse any calcium soap or other insoluble metalic soap formed by drag-in. Typical examples of suitable detergents include sodium alkyl benzene sulphonates, sodium alkyl sulphates, and sodium alkylpolyoxyalkylene sulphates all having 8 to 22 aliphatic carbon atoms. Particularly preferred detergents include, for example, the sodium salts of oleyl-N-Methyltaurine, oleyl-p-anisidine sulphuric acid, sulphonates of alkyl hydrogenated indoles, the sulpho-ethyl ester of oleic acid $$CH_3(CH_2)_7CH{=}CH(CH_2)_7COO(CH_2)_2SO_3^-Na^+$$

and alkali metal or amine salts of a higher fatty acid ester of a lower sulphocarboxylic acid amide, e.g.

$$C_{11}H_{23}COO\ CH_2.CH_2NHCO.CH_2SO_3^-Na^+$$

The concentration of dispersant is typically up to about 5% e.g. 0.01% to 1.0%.

Our soap solution may also contain a phosphate such as sodium tripolyphosphate to assist low temperature storage, or an alcohol.

The duration of the soap treatment is not highly critical. We have found immersion for about 5 seconds to be both adequate and convenient, but shorter times down to 1 second, or even less, are possible. Longer times are, of course, operative but offer little or no advantage.

The pH of the soap solution is preferably neutral or more preferably alkaline to avoid precipitation of free carboxylic acid. There is no apparent upper limit to the pH. Solutions containing, for example, sodium hydroxide to pH 14 have been used without difficulty. We usually prefer to maintain a pH above 6, e.g. 7 or over to prevent precipitation by drag-in of acid.

The temperature of the soap solution has not been found to affect the dewatering, provided of course that the solution is a pourable liquid at the temperature selected.

Boiling solutions and solutions below 20° C. have been used with no apparent adverse effect.

On removal from the soap solution the work does not give any indication of the presence of any water repellent film and shows no obvious sign of dewatering. But after immersion in a final rinse bath, with water, the work, on removal from the bath, drains spontaneously with dramatic rapidity. Any remaining droplets can generally be removed by shaking.

This behavior is the opposite to what would have been expected, since the soap solution would be expected to drain more rapidly than the water, by virtue of its lower surface tension.

A particular advantage of the invention is the enhanced corrosion resistance observed, especially after treatment in trivalent chromium electroplating baths, even in the absence of a final aqueous rinse.

It is generally preferred, but not essential, to use soft water in the preliminary rinse, to reduce or prevent the loss of soap due to precipitation by the calcium or magnesium ions which are present in the drag-in when hard water is used. The final rinse is fully operative with hard water. Preferably the water used in the final rinse is substantially free from soap or other surfactants.

The invention will be illustrated by the following examples:

EXAMPLE 1

A length of steel tube of diameter 20 mm, such as is used in the production of tubular steel furniture, was processed in the following way:

(a) prepared and pre-cleaned for electroplating
(b) electroplated with nickel
(c) rinsed in water
(d) electroplated with chromium, using an electrolyte based on a trivalent chromium salt
(e) rinsed in water
(f) immersed for 30 sec. in demineralised water containing 1 g/l potassium stearate, at 20° C.
(g) rinsed in demineralised water.

After step (f), the solution drained from the tube to leave a fully wetted surface. After step (g) the rinse water was rapidly shed from the surface, leaving it dry but for a few small isolated droplets, in the manner characteristic of a water repellent surface.

A second tube was processed in a similar way, but omitting step (f). After step (g) the water drained to leave a wetted surface, and the tube was dried in a hot air stream.

Both tubes were then placed in a humidity cabinet for 64 hrs., the temperature cycling between 40° C. and 45° C. They were then removed and cut longitudinally, for inspection of the internal surface. The tube processed as first described was substantially free from rust on its external surface, and also on its internal surface, even though the electrodeposited coating extended only a few mm from the open ends. The second tube, which was not rinsed in the soap solution was stained and exhibited a few rust spots on the external surface, and was severely rusted on the unplated internal surface.

EXAMPLE 2

A brass test panel was processed in the following manner:

(a) prepared and precleaned for electroplating
(b) electroplated with zinc using a proprietary bright acid zinc process
(c) rinsed in water
(d) immersed in 0.25% v/v nitric acid to remove the surface film of brightner
(e) rinsed in water
(f) immersed for 30 seconds in a solution of 2 g/l sodium oleate and 0.3 g/l sodium lauryl ether sulphate in tap water at 20° C.
(g) rinsed in demineralised water.

After step (f), the solution drained from the panel to leave a fully wetted surface. After step (g) the rinse water was rapidly shed from the surface in the manner characteristic of a water repellent surface.

A second test panel was processed in a similar manner, but omitting step (f). After step (g), the water drained to leave a wetted surface, which required drying in a warm air stream.

EXAMPLE 3

A mild steel test panel was processed in the following manner:

(a) solvent degreased
(b) electrocleaned in a proprietary alkaline aqueous cleaner
(c) rinsed in water
(d) pickled in a solution of equal volumes of hydrochloric acid (sp.gr. 1.16) and water
(e) rinsed in demineralised water
(f) immersed for 10 seconds in tap water containing 1 g/l sodium oleate and 0.1 g/l sodium oleyl-N-Methyl taurine (Igepon T), at 60° C.
(g) rinsed in tap water at 40° C.

After (f) the solution drained from the test panel to leave a fully wetted surface. After step (g) the rinse water was rapidly shed from the surface, leaving it dry but for a few small droplets, in the manner characteristic of a water repellent surface. The surface was free from all traces of rust after exposure for 1 week on the laboratory bench, and 96 hours in a humidity cabinet under the conditions described in Example 1.

A second mild steel panel was processed in a similar manner but omitting step (f). After step (g) the water drained to leave a wetted surface which was dried in a hot air stream. Before the drying was completed the test panel showed extensive rusting.

EXAMPLE 4

A brass test panel was processed in the following manner:

(a) prepared and precleaned for electroplating
(b) electroplated with copper using a proprietary pyrophosphate based electrolyte
(c) rinsed in water
(d) immersed for 10 seconds in a solution of 0.5 g/l sodium palmitate in demineralised water at 80° C.
(e) rinsed in tap water at 60° C.

After step (e) the rinse water was rapidly shed from the surface, leaving it dry but for a few small droplets in the manner characteristic of a water repellent surface.

The surface was free from tarnishing and retained the characteristic colour of clean copper after 1 weeks on the laboratory bench.

A second test panel was processed in a similar manner but omitting step (d). After step (e) the water drained to leave a wetted surface, which required drying in a warm air stream. Within 1-2 minutes the copper surface was beginning to tarnish and after 1 day on the laboratory bench had taken on a rich golden/orange colour characteristic of air oxidised copper. EXAMPLE 5

A test piece of commercial purity aluminum sheet was processed in the following manner:

(a) etched in a sodium hydroxide based proprietary etching solution for 5 minutes at 60° C.
(b) rinsed in water
(c) immersed for 10 seconds in a solution of 1.0 g/l sodium oleate in demineralised water at 60° C.
(d) rinsed in tap water at 40° C.

After step (d) the rinse water was rapidly shed from the surface, leaving it dry but a few small droplets in the manner characteristic of a water repellent surface.

A second test piece of the same material was processed in a similar manner but omitting step (c). After step (d) the water drained to leave a wetted surface which required drying in a warm air stream.

A third test piece was processed through steps (a) and (b) and then:

(i) immersed in 50/50 (vol) commercial nitric acid to desmut the surface
(ii) rinsed in water and continued through steps (c) and (d).

After step (d) the rinse water was rapidly shed from the surface, in the manner characteristic of a water repellent surface.

A test piece processed through steps (a) and (b) but then treated in a proprietary silicate inhibited alkaline cleaner and rinsed in water before proceeding to steps (c) and (d) drained to leave a wetted surface which required drying in a warm air stream.

A further test piece, again of commercial purity aluminium, was processed through steps (a) and (b) then treated in a silicate inhibited alkaline cleaner and rinsed. The test piece was then treated for 30 seconds in a solution of 5% v/v sulphuric acid containing 1% v/v hydrofluoric acid and rinsed before being subjected to steps (c) and (d). This treatment resulted in a surface which shed water in the manner characteristic of a water repellent surface.

EXAMPLE 6

A test piece of platinum sheet was processed in the following manner:

(a) clean in a proprietary sodium hydroxide/surfactant cleaner to give a surface which was fully water wetted after thorough rinsing
(b) rinse in demineralised water
(c) immersed for 30 secs. in demineralised water containing 0.5 g/l sodium stearate at 80° C.
(d) rinsed in demineralised water.

After step (c) the solution drained from the surface leaving it fully wetted. After step (d) the rinse water was rapidly shed from the surface, leaving it dry but for a few small droplets, in the manner characteristic of a water repellent surface.

A second piece of platinum sheet was processed in a similar manner but omitting step (c). After step (d) the water drained to leave a wetted surface, which was wiped dry with a tissue.

EXAMPLE 7

A panel of stainless steel was processed as follows:

(a) electro polished in a proprietary acidic electropolishing solution,
(b) rinsed in water
(c) immersed for 30 seconds in a solution of 2 g/l sodium oleate and 0.3 g/l sodium lauryl ether sulphate in tap water at 60° C.
(d) rinse in tap water at 40° C.

After this treatment the water drained from the surface to leave a fully wetted surface.

A second panel of stainless steel was processed in a similar manner to the above, but after electroplating and rinsing (steps (a) and (b)) the test piece was:

(i) immersed in 50/50 v/v commercial hydrochloric acid for 30 seconds at room temperature
(ii) rinsed in water before being subjected to steps (c) and (d).

After step (d) the surface shed water in a manner characteristic of a water repellent surface.

EXAMPLE 8

A piece of high purity aluminum sheet was processed in the following manner:

(a) chemical polished in a proprietary solution based on phosphoric and nitric acids at 100° C. for 3 mins.
(b) rinsed in water at 40° C.
(c) immersed in 50/50 v/v nitric acid to remove surface smut
(d) rinsed in water
(e) immersed in a 1 g/l solution of a commercial soap flake at 60° C. for 5 seconds.
(f) rinsed in water at 60° C.

After step (e) the solution drained from the test piece to leave a fully wetted surface. After step (f) the rinse water was shed rapidly, leaving it dry but for a few isolated droplets, in the manner characteristic of a water repellent surface.

A second piece of aluminium sheet was processed in the above manner as far as step (d) and then:

(i) anodised in sulphuric acid for 5 minutes
(ii) rinsed in water

Continued through steps (e) and (f).

After step (e) the solution drained from the test piece to leave fully wetted surface.

After step (f) the rinse water was shed rapidly, in the manner characteristic of a water repellent surface.

A third piece of aluminium was processed through steps (a) (b) (c) (d) (i) and (ii) and then sealed in boiling demineralised water for 5 mins., before being subjected to steps (e) and (f).

After steps (e) and (f) the sample drained to leave a fully wetted surface.

EXAMPLE 9

A brass test panel was processed in the following manner:

(a) prepared and precleaned for electroplating
(b) electroplated with zinc using a proprietary acid zinc process
(c) rinsed in water
(d) treated for 10 seconds in a proprietary chromate passivation process giving a blue finish
(e) rinsed in water
(f) immersed for 30 seconds in a solution of 2 g/l sodium oleate and 0.3 g/l sodium lauryl ether sulphate in tap water at 60° C.
(g) rinsed in demineralised water at 40° C.

After step (f) the solution drained from the panel to leave a fully wetted surface. After step (g) the rinse water was rapidly shed from the surface in the manner characteristic of a water repellent surface.

EXAMPLES 10 TO 23

The following treatments were each followed by immersion in a solution of 4.9/l sodium oleate, 0.3 g/l sodium lauryl ether sulphate at 60° C., and the rinsing in demineralised water at 40° C. In all cases the work dewatered rapidly after the final rinse.

Example 10 (i) Zinc cyanide electroplating (ii) rinse
Example 11 (i) Zinc cyanide electroplating (ii) rinse (iii) 0.5% nitric acid (iv) rinse
Example 12 (i) Acid zinc electroplating (ii) rinse
Example 13 (i) Hexavalent chromium plating (ii) rinse
Example 14 (i) Hexavalent chromium plating (ii) rinse (iii) sodium bisulphite (iv) rinse
Example 15 (i) Copper cyanide electroplating (ii) rinse
Example 16 (i) Acid copper sulphate electroplating (ii) rinse
Example 17 (i) Bright nickel electroplating (ii) rinse
Example 18 (i) Nickel sulphamate electroplating (ii) rinse
Example 19 (i) Alkali cleaning of mild steel sheet (ii) rinse
Example 20 (i) Alkali cleaning of brass sheet (ii) rinse
Example 21 (i) Alkali cleaning of brass sheet (ii) rinse (iii) 10% sulphuric acid (iv) rinse
Example 22 (i) Alkali cleaning of platinum sheet (ii) rinse (iii) 10% sulphuric acid (iv) rinse
Example 23 (i) Alkali cleaning of 9 carat gold sheet (ii) rinse (iii) 10% sulphuric acid (iv) rinse

We claim:

1. In the method of treating articles which consists essentially of subjecting the article to an aqueous metal finishing treatment which includes at least one operation selected from the electrodeposition of metal on said article, the chemical deposition of metal on said article, the chemical removal of metal from said article, the electrochemical removal of metal from said article, and acid pickling, and which treatment provides a wet, free metal or metallic ion-containing surface, exposed to the environment and rinsing and drying said wet surface after the last step of said treatment, the improvement which consists of (a) rinsing in water said wet, free metal or metallic ion-containing surface after said metal finishing treatment sufficiently essentially to remove any treatment solution capable of precipitating soap, then (b) contacting said wet surface after step (a) with an aqueous solution containing at least 0.05 gram per liter of a water soluble soap, said soap being at least one salt of an aliphatic carboxylic acid having from 10 to 24 carbon atoms, (c) rinsing said wet surface after step (b) with water, and then (d) draining said wet surface to form a dry surface.

2. An improved method according to claim 1 wherein said metal finishing treatment consists essentially in electrodepositing a metal to form said surface.

3. A method according to claim 2, wherein said electrodeposited metal is selected from the group consisting of copper, zinc, cadmium, cobalt, nickel, iron, chromium, silver, gold, platinum, lead, tin, and alloys thereof.

4. An improved method according to claim 1 wherein said metal finishing treatment consists essentially in the dissolution of metal from a metal surface.

5. An improved method according to claim 1 wherein said metal finishing treatment consists essentially in the removal of an grease from a metal surface.

6. An improved method according to claim 1 wherein said metal finishing treatment consists essentially in the electropolishing of stainless steel followed by contacting the electropolished steel with hydrochloric acid.

7. An improved method according to claim 1 wherein said metal finishing treatment consists essentially in the chromate passivation of zinc.

8. In the method of metal finishing which consists essentially of electrodepositing a bright chromium deposit on a metal work piece from a solution of a trivalent chromium salt, rinsing in water said work piece while still wet after said electrodeposition and drying said work piece, the improvement which consists of contacting said work piece after said finishing and while still wet and at least prior to said drying with an aqueous solution of a water soluble soap which comprises at least 0.1 gram per liter of water soluble salts of an aliphatic carboxylic acid having from 10 to 24 carbon atoms and then rinsing said work piece with water and then draining said rinse water.

9. An improved method according to claim 8 or 1 wherein said water soluble soap is a salt of an aliphatic carboxylic acid selected from sodium, potassium, ammonium, and ethanolamine salts.

10. An improved method according to claim 9 wherein said water soluble salt has from 12 to 18 carbon atoms.

11. An improved method according to claim 10 wherein said water soluble salts are selected from the group consisting of stearates, palmitates, dodecanoates, myristates, oleates, linoleates, linolenates, and resinates and mixtures thereof.

12. An improved method according to claim 1 wherein said water soluble soap is a mixture of salts selected from the group consisting of the sodium and potassium salts, of saturated and unsaturated non-cyclic aliphatic acids having from 14 to 18 carbon atoms and are present in a total concentration of from 0.5 to 5 grams per liter.

13. An improved method according to claim 12 wherein said solution of said water soluble salts additionally contains an effective amount of anionic detergent which is not a water soluble salt of an aliphatic carboxylic acid.

14. An improved method according to claim 13 wherein said solution of said water soluble salts is maintained at a pH of at least 7.

* * * * *